US011331914B2

(12) United States Patent
Sohgawa

(10) Patent No.: US 11,331,914 B2
(45) Date of Patent: May 17, 2022

(54) DROPLET DISCHARGING APPARATUS AND DRIVING WAVEFORM CONTROL METHOD

(71) Applicant: Norimasa Sohgawa, Kanagawa (JP)

(72) Inventor: Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/020,992

(22) Filed: Sep. 15, 2020

(65) Prior Publication Data

US 2021/0094291 A1 Apr. 1, 2021

(30) Foreign Application Priority Data

Sep. 27, 2019 (JP) ..... JP2019-177362
May 22, 2020 (JP) ..... JP2020-090039

(51) Int. Cl.
*B41J 2/045* (2006.01)
*B41J 2/155* (2006.01)

(52) U.S. Cl.
CPC ..... *B41J 2/04588* (2013.01); *B41J 2/04581* (2013.01); *B41J 2/155* (2013.01)

(58) Field of Classification Search
CPC . B41J 2/04593; B41J 2/04581; B41J 2/04588
See application file for complete search history.

(56) References Cited

U.S. PATENT DOCUMENTS 6,412,923 B1 * 7/2002 Takahashi ..... B41J 2/04588 347/68
6,494,556 B1 12/2002 Sayama et al.
8,857,935 B2 * 10/2014 Endo ..... B41J 2/04593 347/10
9,108,432 B2 8/2015 Sohgawa
9,643,414 B2 5/2017 Sohgawa et al.
10,022,963 B2 7/2018 Kohda et al.
10,730,292 B2 8/2020 Kohda et al.
2007/0008356 A1 1/2007 Katoh
2014/0055513 A1 * 2/2014 Usui ..... B41J 2/04581 347/11
2015/0306891 A1 10/2015 Sohgawa et al.
2017/0008278 A1 1/2017 Hiyoshi et al.
2019/0270308 A1 9/2019 Watanabe et al.
2019/0283411 A1 9/2019 Sohgawa
2019/0283413 A1 9/2019 Katoh et al.
2020/0101726 A1 4/2020 Sohgawa
2020/0147973 A1 5/2020 Sohgawa
2020/0171819 A1 6/2020 Sohgawa

FOREIGN PATENT DOCUMENTS

JP 3384388 3/2003
JP 2004-330514 11/2004
JP 2017-013461 1/2017

* cited by examiner

*Primary Examiner* — Lam S Nguyen
(74) *Attorney, Agent, or Firm* — IPUSA, PLLC

(57) ABSTRACT

A droplet discharging apparatus that discharges liquid droplets from one or more nozzles based on drive waveforms, includes a memory and a processor configured to execute generating, as the drive waveforms, a first drive waveform, and a second drive waveform to change a drive voltage without discharging the liquid droplets; and controlling to output one set of drive waveforms including a predetermined number of instances of the first drive waveform and one instance of the second drive waveform.

11 Claims, 13 Drawing Sheets

| GRADATION VALUE | 1ST PULSE | 2ND PULSE | 3RD PULSE | 4TH PULSE | 5TH PULSE | 6TH PULSE | 7TH PULSE | DECODE VALUE |
|---|---|---|---|---|---|---|---|---|
| 1(00) | × | ○ | × | × | × | ○ | × | (0100010) |
| 2(01) | × | × | × | ○ | × | × | × | (0001000) |
| 3(10) | ○ | × | × | × | × | × | ○ | (1000001) |
| 4(11) | ○ | × | × | ○ | × | × | ○ | (1001001) |

DROPLET DISCHARGING APPARATUS AND DRIVING WAVEFORM CONTROL METHOD

CROSS-REFERENCE TO RELATED APPLICATIONS

The present application claims priority under 35 U.S.C. § 119 of Japanese Patent Application No. 2019-177362 filed on Sep. 27, 2019, and Japanese Patent Application No. 2020-090039 filed on May 22, 2020, the entire contents of which are hereby incorporated by reference.

BACKGROUND OF THE INVENTION

1. Field of the Invention

The present invention relates to a droplet discharging apparatus and a driving waveform control method.

2. Description of the Related Art

Conventionally, a method of controlling discharge of liquid droplets from nozzles by transmitting a drive waveform for the discharge has been known.

Specifically, first, in order to discharge liquid droplets of ink or the like from the nozzles, a drive signal that represents a drive waveform is transmitted to an actuator. When such a drive signal is applied to the actuator in this way, the actuator vibrates a pressure chamber, which changes the capacity in the pressure chamber. By such control, liquid droplets are discharged. Meanwhile, a method of vibrating a meniscus by performing so-called precursor minute vibration has been known, which vibrates an actuator to an extent such that liquid droplets are not discharged from the nozzles (see, for example, Japanese Laid-Open Patent Application No. 2017-13461).

However, in the conventional methods, in the case of inputting a drive waveform to perform fine-driving, it is often the case that the length of the drive waveform is increased. Therefore, there has been a problem that it is not possible to perform driving at high frequency.

SUMMARY OF THE INVENTION

According to one embodiment of the present invention, a droplet discharging apparatus that discharges liquid droplets from one or more nozzles based on drive waveforms, includes a memory and a processor configured to execute generating, as the drive waveforms, a first drive waveform, and a second drive waveform to change a drive voltage without discharging the liquid droplets; and controlling to output one set of drive waveforms including a predetermined number of instances of the first drive waveform and one instance of the second drive waveform.

BRIEF DESCRIPTION OF DRAWINGS

Other objects and further features of embodiments will be apparent from the following detailed description when read in conjunction with the accompanying drawings, in which.

DETAILED DESCRIPTION OF THE EMBODIMENTS

Figure 1:
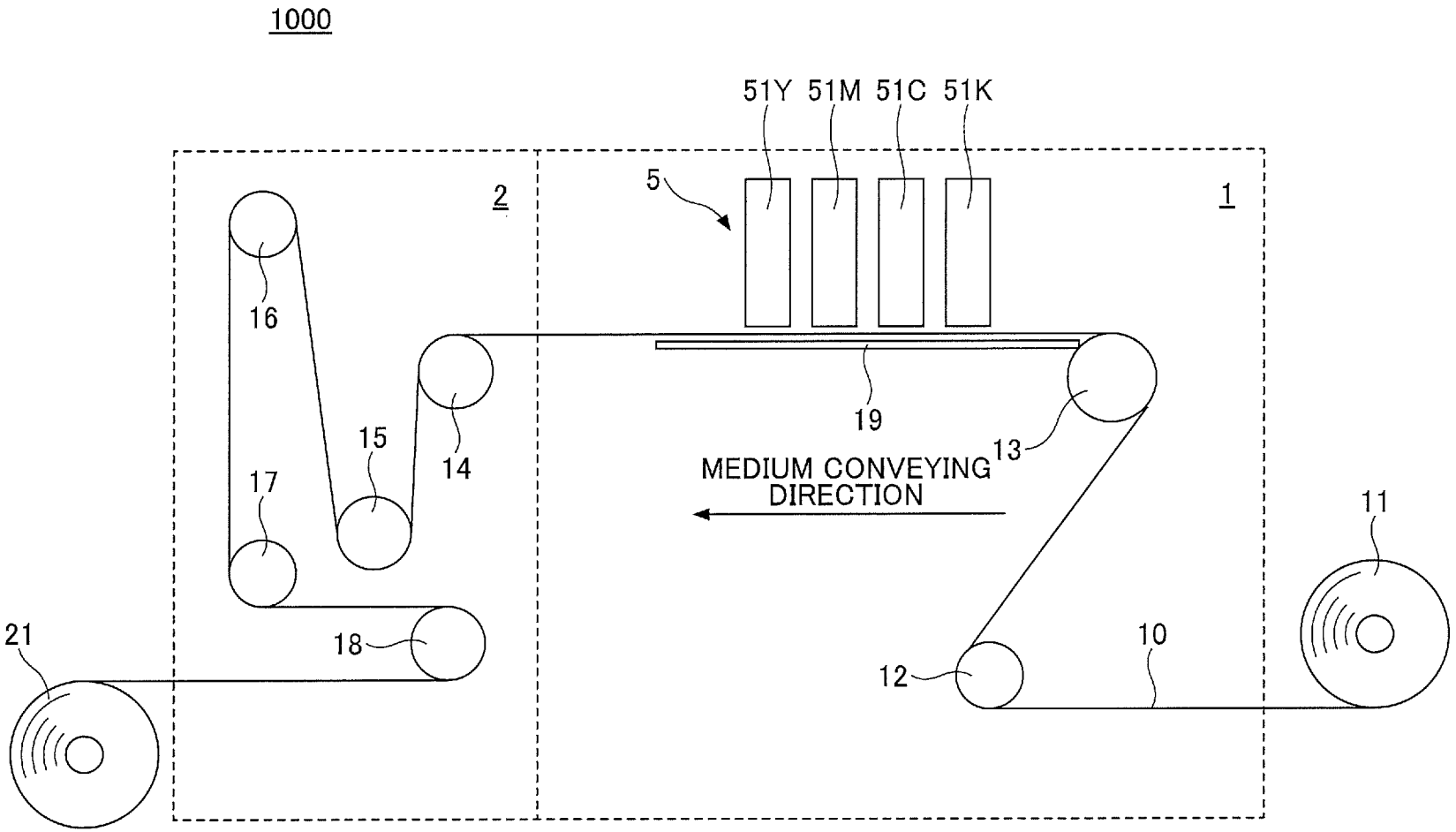
FIG. 1 is a diagram illustrating an example of an overall configuration of a droplet discharging apparatus.

In the following, an optimum and minimum form for carrying out the present inventive concept will be described with reference to the drawings. Note that in the drawings, the same reference numerals indicate substantially the same elements, and duplicate descriptions may be omitted. Also, illustrated specific examples are merely exemplification, which may be configured to further include elements other than those illustrated.

According to one aspect of the present invention, fine-driving is executed at an interval rate of one cycle per a predetermined number of drive cycles, by providing a period of time in a drive waveform as a buffer wherein the length of the period is shorter than the waveform length of the fine-driving, and is about a unit fraction (having a denominator of a single digit) of the length of the fine-driving, and by repeating a predetermined number of times of drive cycles to accumulate a waveform length equivalent to one time of fine-driving. Thus, it is possible to perform driving at a higher frequency by shortening the drive waveform length in this way, compared to the conventional control that requires the full length of a waveform for the fine-driving in every drive cycle.

First Embodiment

<Example of Droplet Discharging Apparatus>

FIG. 1 is a diagram illustrating an example of an overall configuration of a droplet discharging apparatus. A droplet discharging apparatus 1000 is, for example, a device equipped with a so-called full-line head. Also, the droplet discharging apparatus 1000 is configured to include, for example, a main body 1 and an outlet unit 2.

In the following, as illustrated, an example will be described where the medium onto which liquid droplets are discharged is continuous paper 10. In this example, the continuous paper 10 is rolled out from the unwinding roller 11. Then, the continuous paper 10 is conveyed by conveyance rollers 12-18 and the like. Also, an image or the like is formed on the continuous paper 10 when liquid droplets are discharged during the conveyance. Next, the outlet unit 2 may perform post-processing. Through such processing, the continuous paper 10 is rolled up by a winding roller 21.

In the illustrated configuration, the main body 1 performs image formation. Meanwhile, the outlet unit 2 may perform drying or the like as a post process, for example, after the image formation.

The discharge unit 5 discharges liquid droplets onto the continuous paper 10 to form an image or the like. Specifically, in the illustrated example, the discharge unit 5 performs image formation between the conveyance roller 13 and the conveyance roller 14. Also, as illustrated, the continuous paper 10 is conveyed on a conveyance guide 19 during image formation.

The discharge unit 5 includes, for example, four colors of ink. Specifically, the discharge unit 5 has a configuration that includes a black head unit 51K, a cyan head unit 51C, a magenta head unit 51M, and a yellow head unit 51Y. In the following, in the case of referring to any one of the head units of the four colors, the head(s) may be simply referred to as the "head unit(s) 51". Note that the types, number, order, and the like of the colors may be configured to be different from those illustrated in the figure.

Figure 2:
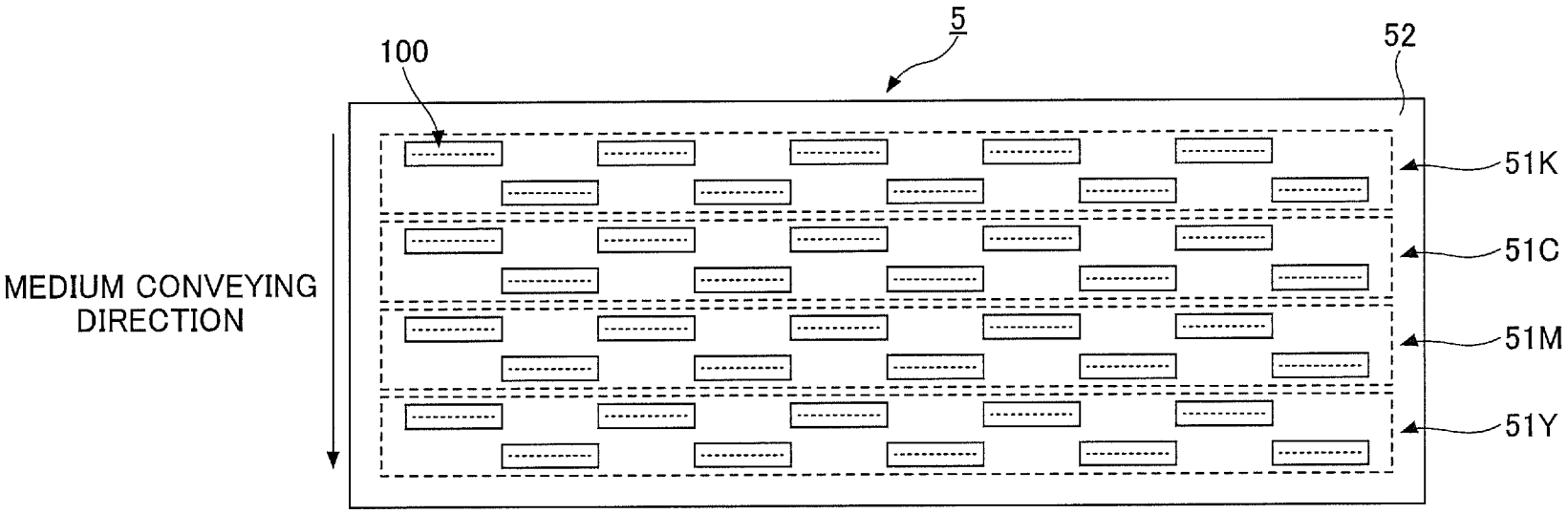
FIG. 2 is a diagram illustrating an example of a configuration of a discharge unit.

FIG. 2 is a diagram illustrating an example of a configuration of the discharge unit 5. For example, the discharge unit 5 is constituted with the head units 51 each including multiple liquid droplet heads to discharge liquid droplets (hereafter, simply referred to as the head(s) 100).

The heads 100 are arranged to have a staggered layout on a base member 52, to form a so-called head array. Also, the head unit 51 is constituted with, for example, the heads 100 and head tanks that feed liquid droplets. However, the head unit 51 may be configured to include a single head 100, or the like.

Figure 3:
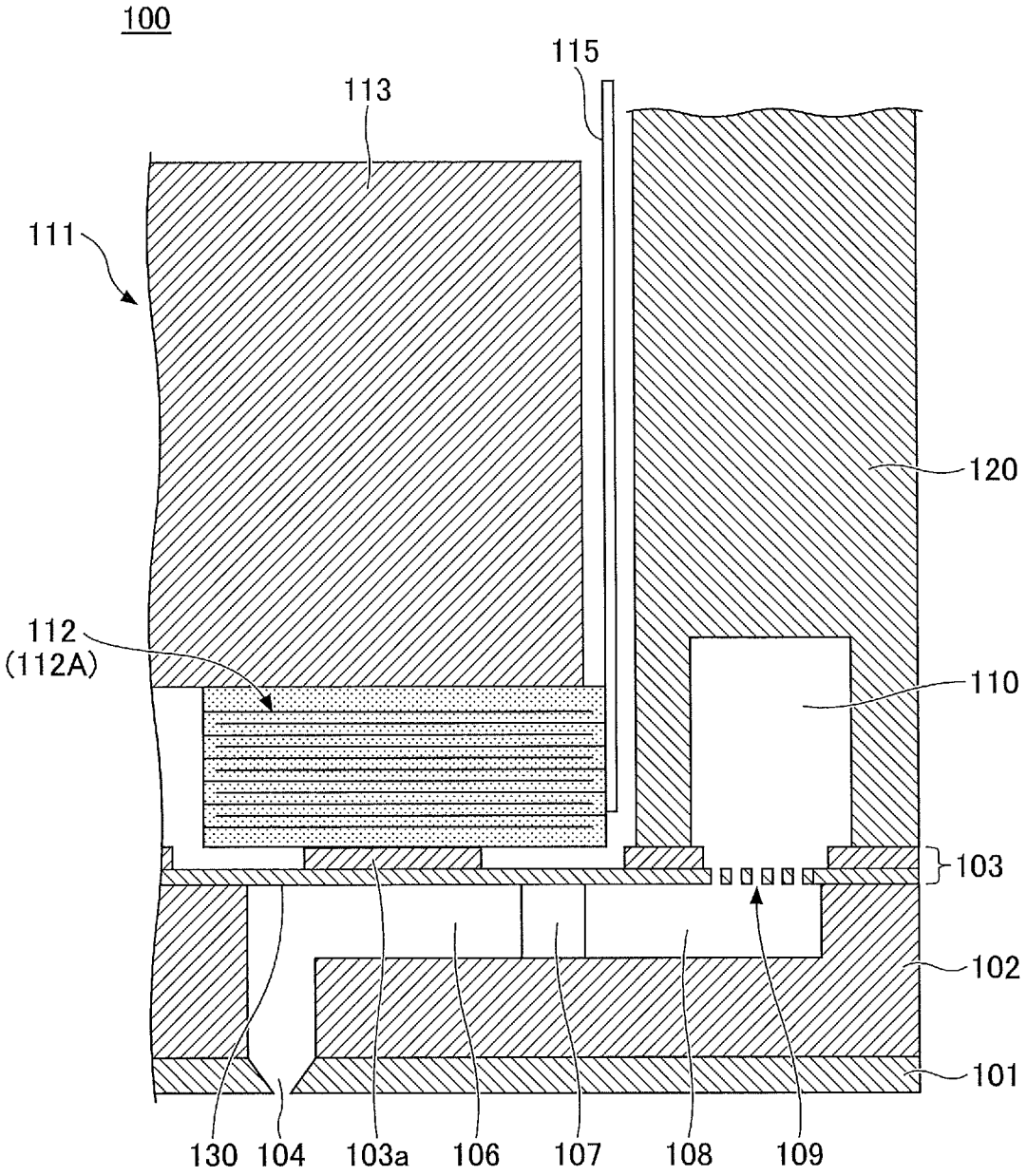
FIG. 3 is a diagram illustrating an example of a configuration of a head.

FIG. 3 is a diagram illustrating an example of a configuration of the head 100. The figure is a cross-sectional view of the head 100 in a direction orthogonal (i.e., also corresponding to the longitudinal direction with respect to the liquid chamber) to a direction in which the nozzles are aligned.

Figure 4:
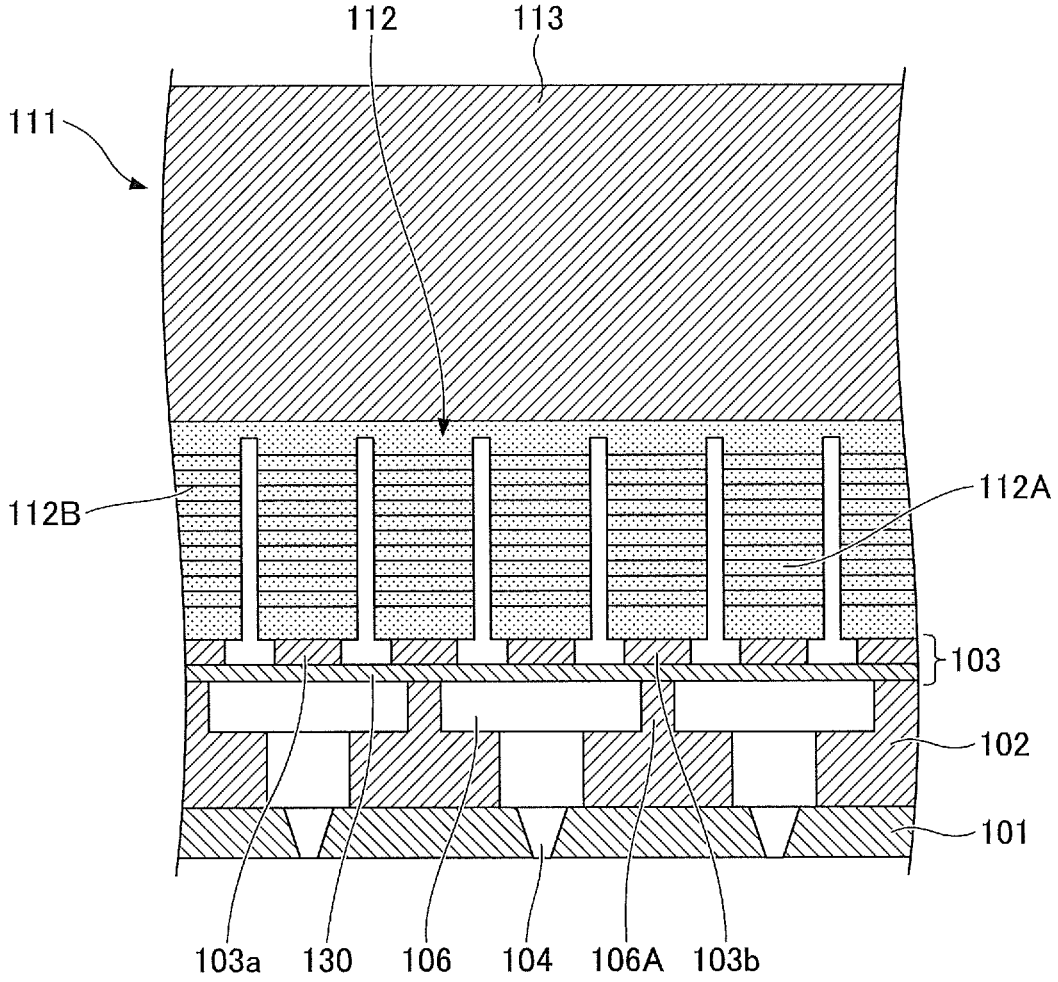
FIG. 4 is a diagram illustrating an example of a configuration of a head.

FIG. 4 is a diagram illustrating an example of a configuration of the head 100. The figure is a cross-sectional view of the head 100 in the direction in which the nozzles are aligned (i.e., also corresponding to the short direction with respect to the liquid chamber).

For example, the head 100 is configured to include a nozzle plate 101, a channel plate 102, and a vibrating plate member 103. Further, the head 100 is configured to include a piezoelectric actuator 111 and a frame member 120.

The piezoelectric actuator 111 is an example of an actuator, which deforms the vibrating plate member 103.

The frame member 120 serves as a common channel member or the like.

The head 100 also includes individual liquid chambers 106, liquid droplet feeding channels 107, and liquid droplet introducing parts 108, and the like.

The individual liquid chamber 106 is an example of a liquid chamber leading to a nozzle 104. Note that a liquid chamber may also be referred to as a pressure chamber, a pressurization chamber, simply a liquid chamber, or the like.

The liquid droplet feeding channel 107 also serves as a fluid resistance to feed liquid droplets into the individual liquid chamber 106.

The liquid droplet introducing part 108 is an introducing part to the liquid droplet feeding channel 107.

Also, in the case where there are multiple individual liquid chambers 106, a partition wall 106A is provided between individual liquid chambers 106 adjacent to each other in the direction in which the nozzles are aligned. In other words, the multiple individual liquid chambers 106 are separated by the partition walls 106A.

A liquid droplet is supplied to the individual liquid chamber 106 via a common channel formed by the frame member 120, namely, via the common liquid chamber 110, a filter 109, the liquid droplet introducing part 108, the liquid droplet feeding channel 107, and the like.

For example, the piezoelectric actuator 111 is arranged at a position on the opposite side of the individual liquid chamber 106 with respect to the vibration region 130, which is a deformable region among walls forming the individual liquid chamber 106.

The piezoelectric actuator 111 includes a laminated piezoelectric member 112.

Grooving is applied to the laminated piezoelectric member 112, for example, by half-cut dicing. In the illustrated example, the laminated piezoelectric member 112 forms piezoelectric columns 112A, support columns 112B, and the like to have a comb-teeth shape.

The piezoelectric column 112A joins a convex part 103*a* included in the vibration region 130. Also, the support column 112B joins a convex part 103*b* included in the vibration region 130.

The laminated piezoelectric member 112 has a structure in which piezoelectric layers and internal electrodes are alternately laminated. Also, the inner electrodes are drawn out to the respective end surfaces. Then, an external electrode is provided at the drawn ends of the internal electrodes. A drive waveform input into the actuator is input into this external electrode. For example, an FPC (Flexible Printed Circuit), which is a flexible circuit board having flexibility (hereafter, referred to as the FPC 115) is connected to the external electrode.

Liquid droplets are supplied from a head tank, cartridge, or the like to the common liquid chamber 110 formed of the frame member 120 and the like.

In the configuration as above, for example, when the voltage applied to the laminated piezoelectric member 112 (an example of drive voltage; hereafter, simply referred to as the voltage) is set to a value lower than the intermediate potential, the laminated piezoelectric member 112 shrinks. Such shrinkage expands the capacity of the individual liquid chambers 106. Then, liquid droplets flow into the individual liquid chambers 106.

Meanwhile, when the voltage applied to the laminated piezoelectric member 112 is set to a value higher than the intermediate potential, the laminated piezoelectric member 112 expands. Such expansion reduces the capacity of the individual liquid chambers 106. Therefore, the liquid droplets in the individual liquid chambers 106 are pressurized, and thereby, discharged from the nozzles 104.

Then, when the voltage applied to the laminated piezoelectric member 112 is returned to the reference potential, the vibration region 130 restores its initial shape. In this restoration, the individual liquid chambers 106 expands to produce a negative pressure. This negative pressure feeds liquid droplets from the common liquid chamber 110 and the like to the individual liquid chambers 106 through the liquid droplet feeding channels 107 and the like. Then, when the vibration of the meniscus surfaces at the nozzles 104 is damped to become stable, the head 100 starts operating for the next discharge.

Figure 5:
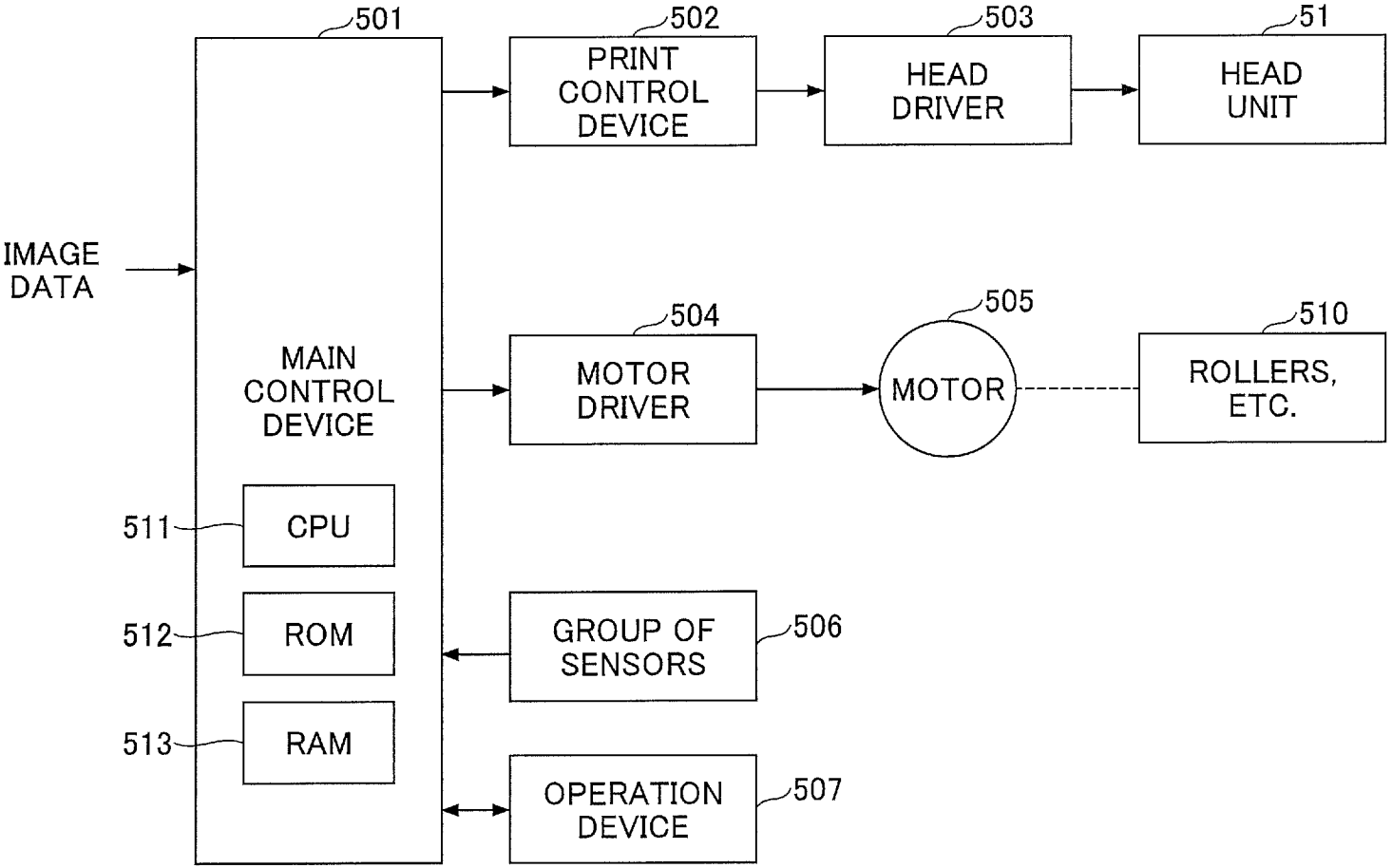
FIG. 5 is a diagram illustrating an example of a hardware configuration.

FIG. 5 is a diagram illustrating an example of a hardware configuration. For example, the droplet discharging apparatus 1000 is configured to include a main control device 501, a print control device 502, a head driver 503, a head unit 51, a motor driver 504, a motor 505, rollers 510, a group of sensors 506, and an operation device 507.

The main control device 501 controls the entire droplet discharging apparatus 1000. The main control device 501 includes, for example, a CPU (Central Processing Unit; hereafter, referred to as the CPU 511), a ROM (Read-Only Memory; hereafter, referred to as the ROM 512), and a RAM (Random Access Memory; hereafter, referred to as the RAM 513). The main control device 501 also includes an interface such as I/O (Input/Output) interfaces to input and output image data and the like.

The CPU 511 is an example of an arithmetic/logic device and a control device.

The ROM 512 and RAM 513 are examples of a storage device.

The main control device 501 receives as input image data, commands, and the like from an external device or the like serving as a host device to be connected. Then, the main control device 501 outputs image data, commands, and the like to the print control device 502 or the like.

The print control device 502 converts image data and the like into serial data and the like, and outputs the converted data to the head driver 503. Also, the print control device 502 outputs clock signals, latch signals, and other control signals to the head driver 503.

The print control device 502 converts pattern data that represents a common drive waveform input in advance into a storage device such as the ROM 512, and outputs the converted data to the head driver 503. In other words, the print control device 502 includes a D/A converter, a voltage amplifier, and a current amplifier.

Based on a drive waveform, the head driver 503 drives the actuator included in the head unit 51, to cause the head unit 51 to discharge liquid droplets. Also, the head driver 503 may select part of the waveform elements included in a drive waveform to separately discharge dots having different sizes, such as large liquid droplets, medium liquid droplets, and small liquid droplets.

The main control device 501 controls the motor 505 via the motor driver 504, so as to drive the unwinding roller 11, the conveyance rollers 12-18, and the winding roller 21 as the rollers 510.

The main control device 501 performs controlling based on sensor signals and the like detected by the group of sensors 506 and the like.

The main control device 501 receives as input an operation performed by the user on the operation device 507 or the like, and outputs a processing result and the like for the user.

Figure 6:
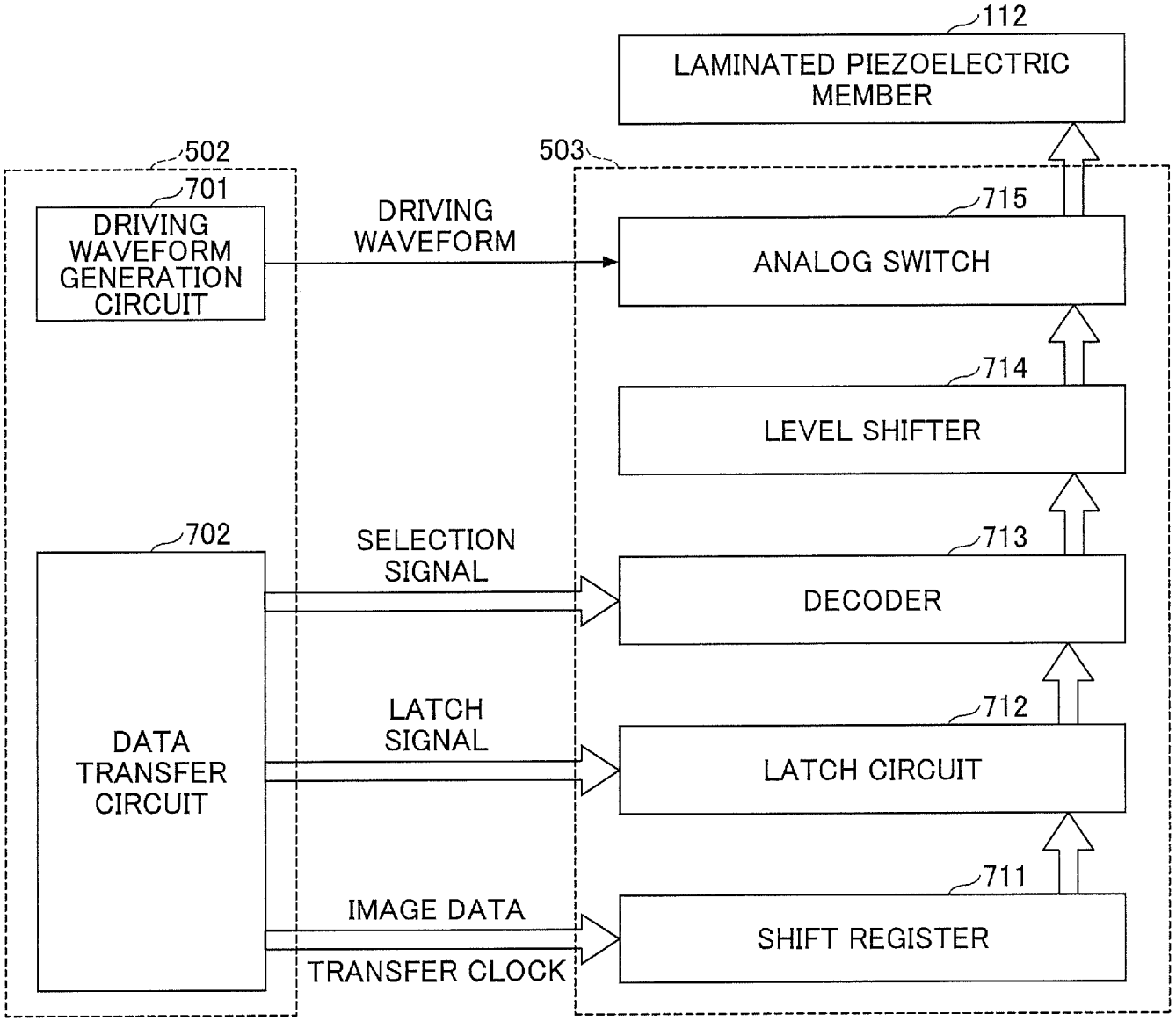
FIG. 6 is a diagram illustrating an example of a configuration of an electronic circuit.

FIG. 6 is a diagram illustrating an example of a configuration of an electronic circuit. The configuration of the electronic circuit as illustrated is implemented with, for example, the print control device 502, the head driver 503, and the like.

The print control device 502 includes, for example, a drive waveform generation circuit 701 and a data transfer circuit 702.

The drive waveform generation circuit 701 generates a drive waveform based on pattern data and the like.

The data transfer circuit 702 generates 2-bit image data depending on an image to be formed. Further, the data transfer circuit 702 outputs clock signals, latch signals, selection signals, and the like.

The head driver 503 includes, for example, a shift register 711, a latch circuit 712, a decoder 713, a level shifter 714, and an analog switch 715.

The shift register 711 received as input a transfer clock (in some cases, referred to as a shift clock or the like) and image data (in a serialized data format) transmitted by the data transfer circuit. Therefore, it is gradation data of two bits per nozzle (i.e., per channel).

The latch circuit 712 latches a value of a register included in the shift register 711.

The decoder 713 decodes gradation data, a selection signal, and the like.

The level shifter 714 converts a signal output by the decoder 713 into a level at which the analog switch 715 operates.

The analog switch 715 switches between on and off based on a signal output by the level shifter 714. Also, the analog switch 715 is connected to the laminated piezoelectric member 112 and the like. Further, the analog switch 715 receives as input a drive waveform. Therefore, among the waveform elements of a drive waveform, predetermined waveform elements pass through to be applied to the laminated piezoelectric member 112, based on switching by the analog switch 715.

Note that the configuration of the electronic circuit and the hardware configuration may include elements other than those illustrated.

<Example of Drive Waveform>

Figure 7:
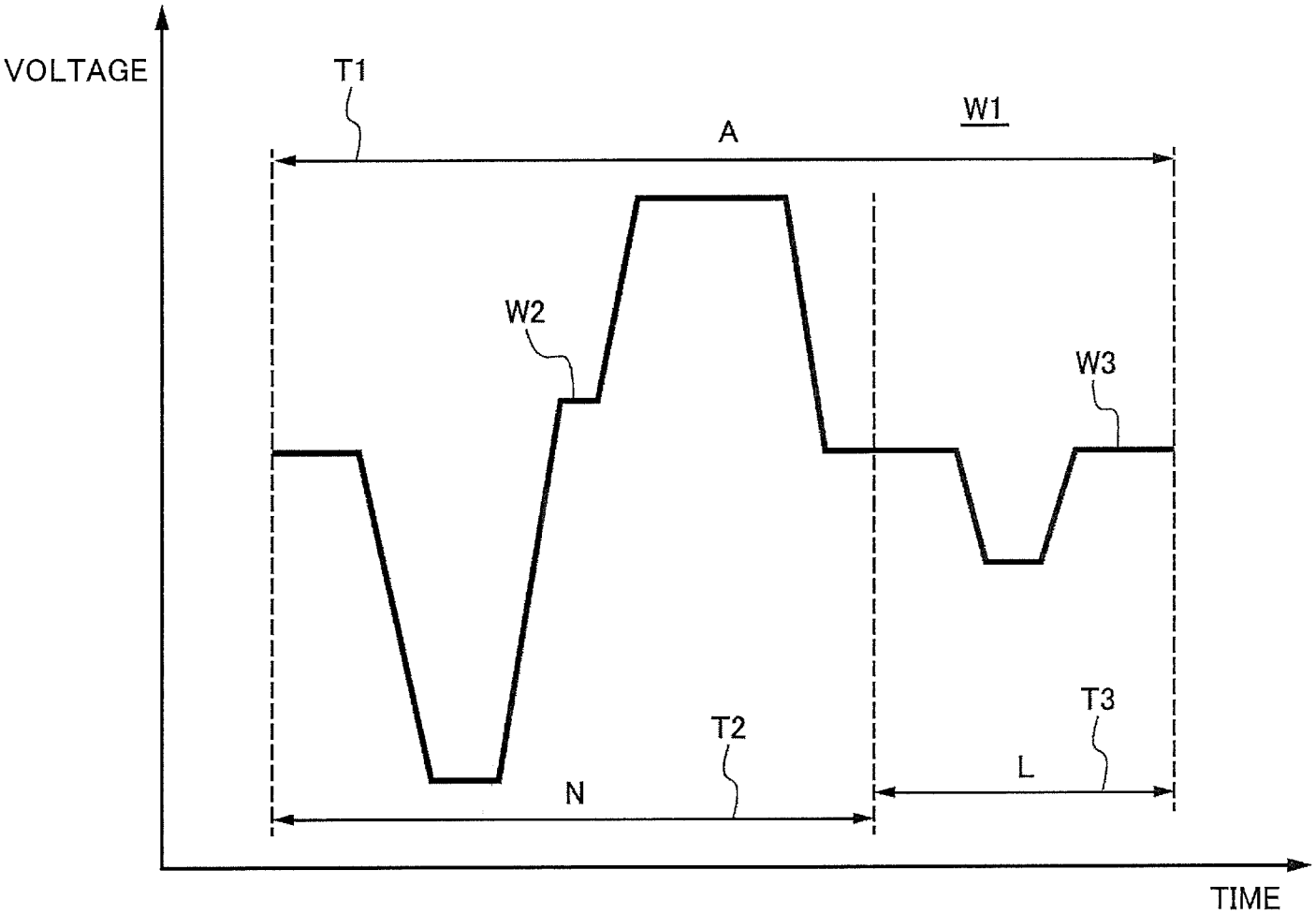
FIG. 7 is a diagram illustrating an example of a reference drive waveform.

FIG. 7 is a diagram illustrating an example of a reference drive waveform. In the following, an example will be described in which a drive waveform as illustrated in the figure is set as a reference (hereafter, referred to as a reference waveform W1).

It is assumed that the length of one cycle of the reference waveform W1 is 'A' μs (μs). In the following, the length of one cycle will be referred to as the reference cycle T1. Also, in the following examples, the reference time is the reference cycle T1 whose length is 'A'.

The reference waveform W1 includes, for example, a drive waveform to cause a nozzle to discharge liquid droplets (hereafter, referred to as the discharge waveform W2). In the following, it is assumed that the length of one cycle (hereafter, referred to as the discharge cycle T2) of a discharge waveform W2 is N μs.

Further, the reference waveform W1 includes, for example, a drive waveform to perform fine-driving (hereafter, referred to as the fine-driving waveform W3). In the following, it is assumed that the length of one cycle (hereafter, referred to as the fine-driving cycle T3) of the fine-driving waveform W3 is L μs.

In addition, in the examples illustrated below, it is assumed that fine-driving is performed at cycles of 4 μs. In other words, it is assumed L=4. Therefore, the following example is an example in which the fine-driving cycle T3 is L=4.

fine-driving is an operation that vibrates the actuator within a range where liquid droplets are not discharged from the nozzles. Note that in some cases, fine-driving is referred to as meniscus oscillation or the like.

Also, in the reference waveform W1, waveform elements that cause fine-driving, namely, the fine-driving waveform W3, is favorably input at the last end of one cycle of the reference waveform W1 as illustrated.

The last end refers to the position where there is no subsequent waveform element in a cycle. Once input at such a position, it is possible to generate a drive waveform that performs discharging, by deleting the last end of the reference waveform W1, namely, by adjusting the reference waveform W1 to be shortened. Therefore, the circuit for changing the drive waveform can be simplified. Thus, the cost associated with the electronic circuit can be reduced.

<Example of Timing to Perform Fine-Driving>

Figure 8:
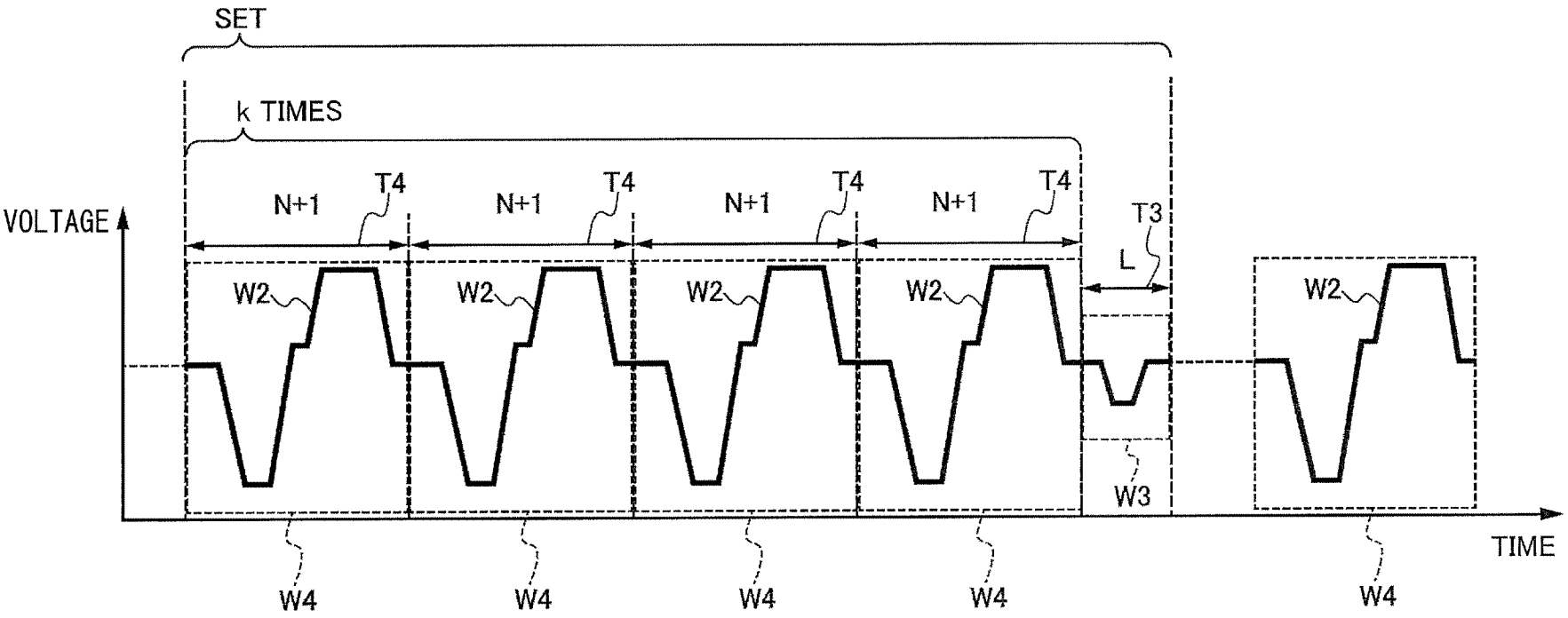
FIG. 8 is a diagram illustrating an example of control to perform discharging and fine-driving.

FIG. 8 is a diagram illustrating an example of control to perform discharging and fine-driving. First, for performing the control as illustrated in the figure, as an example of the first drive waveform, a drive waveform (hereafter, referred to as a short waveform W4) is generated in advance, which is shorter than the reference cycle T1 and includes a discharge waveform W2.

The short waveform W4 has a cycle shorter than that of the reference cycle T1 (hereafter, referred to as the short cycle T4). For example, the short cycle T4 satisfies a relationship with N as in the following formula (1).

$$\text{short cycle } T4 = N+1 \quad (1)$$

An example will be described in which the short cycle T4 is 1 μs longer than the discharge cycle T2. In this example, it is favorable to perform fine-driving by the waveform W3 having L=4, once in k=4 times of discharging based on the short waveforms W4. Such k=4 times of the short waveforms W4 and one fine-driving waveform W3 are denoted as a set cycle=SET.

It is desirable that the set cycle=SET satisfies a relationship with the discharge cycle T2=N, the fine-driving cycle T3=L, and k as an example of a predetermined number of times, as expressed in the following formula (2).

$$\text{SET} = k \times (N+1) + L \quad (2)$$

The short waveform W4 is 1 μs longer than the discharge cycle T2. A relationship of (N+1)=reference cycle T1−3 is satisfied; therefore, a margin can be generated that is shorter than the reference cycle T1 by 3 μs for each operation of discharging. In this way, by using the short waveforms W4, the shortened time accumulates. Then, once a predetermined number of times, namely, k times of discharging based on the short waveforms W4 are completed, the shortened time accumulates to reach k×3.

Therefore, as for the values of SET, k, N, and L, values other than those described above may be used as long as the values satisfy a relationship as expressed in the formula (2) above.

Then, when the accumulation with the short waveforms W4 reaches a predetermined time, fine-driving is performed by the fine-driving waveform W3. In this way, the time relationship of the formula (2) above holds for units of SET.

In other words, SET can be a shortened time compared to k times of reference waveforms W1.

Such control can be implemented in a process of shortening the drive waveform. Therefore, high-speed driving can be implemented without packaging an electronic circuit or the like that generates a drive waveform for each nozzle.

Note that the example illustrated in FIG. 8 shows an example of the ratio of one fine-driving waveform W3 to four discharge waveforms W2; however, the ratio may be other than this. In other words, the frequency at which a fine-driving waveform W3 is added to the number of cycles of the discharge waveforms W2 may be different from the exemplified ratio, depending on the easiness of drying of ink or the size of the opening of the nozzle.

Specifically, the fine-driving waveform W3 may be set with a ratio of once in three to ten discharge waveforms W2.

FIG. 9 is a diagram illustrating an example of operations. In the case of performing the control described above, for example, dots are formed as follows. In the following, four nozzles of a first nozzle 1041, a second nozzle 1042, a third nozzle 1043, and a fourth nozzle 1044 are used in the example.

Figures 9A, 9B:
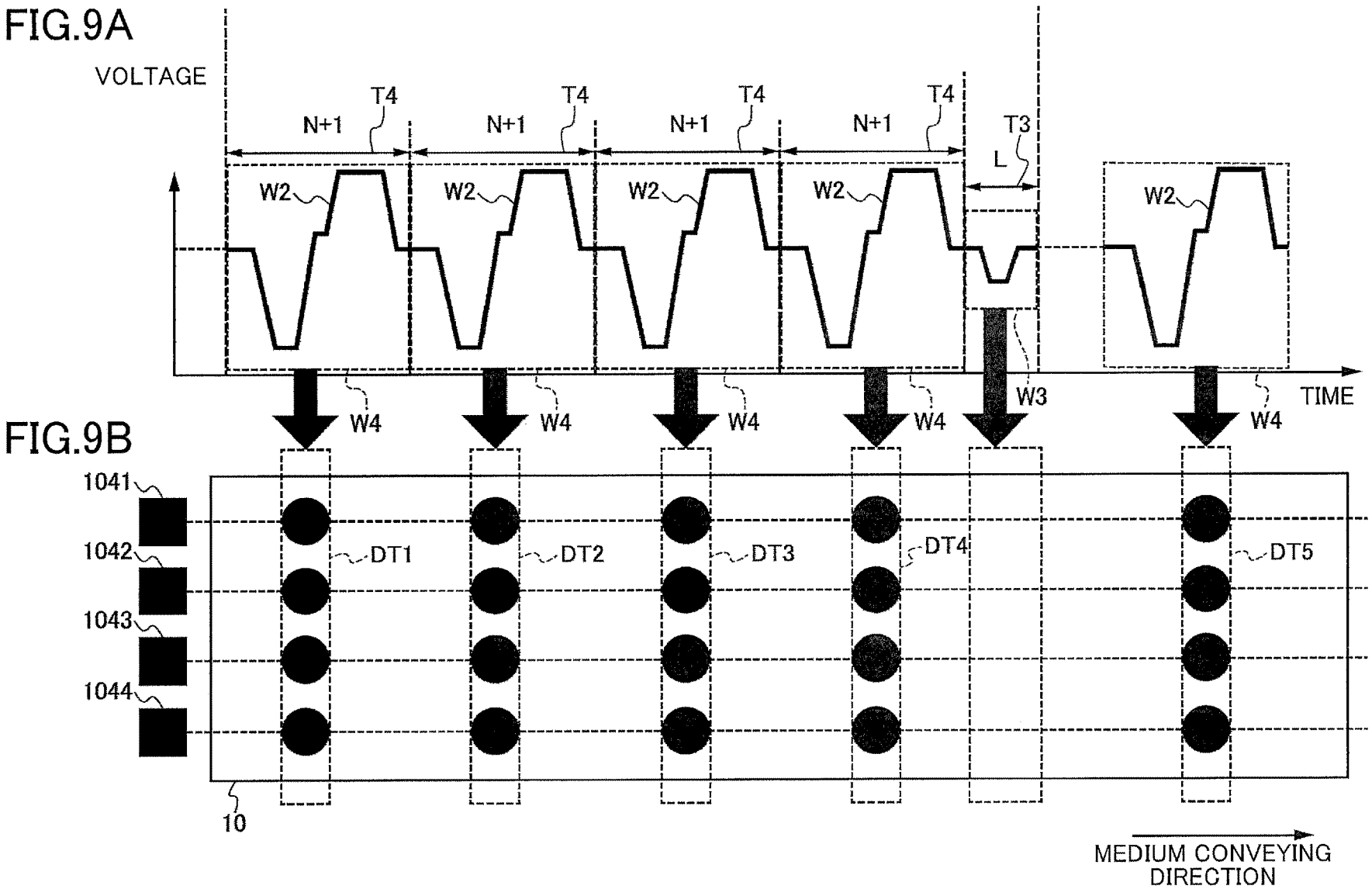
FIGS. 9A and 9B are diagrams illustrating an example of operations.

As illustrated in FIG. 9A, it is assumed that6 the same drive waveform as illustrated in FIG. 8 is input into all of the first to fourth nozzles.

FIG. 9B is an example of dots formed on the continuous paper 10, by the example in which the drive waveform illustrated in FIG. 9A is input.

The first short waveform W4 in this example forms the first group of dots DT1. Similarly, the second group of dots DT2, the third group of dots DT3, and the fourth group of dots DT4 are formed.

The spacing between the first group of dots DT1 and the second group of dots DT2, the spacing between the second group of dots DT2 and the third group of dots DT3, and the spacing between the third group of dots DT3 and the fourth group of dots DT4, are almost the same because the short waveforms W4 are input continuously.

Meanwhile, fine-driving with the fine-driving waveform W3 is performed before discharging the fifth group of dots DT5, and thereby, the spacing between the fifth group of dots DT5 and the fourth group of dots DT4 may be widened. Therefore, the fine-driving cycle T3, or L, is favorably shorter than or equal to 4 μs. In many cases, a length up to this extent is permissible even if the spacing becomes wider.

Comparative Example

Figure 10:
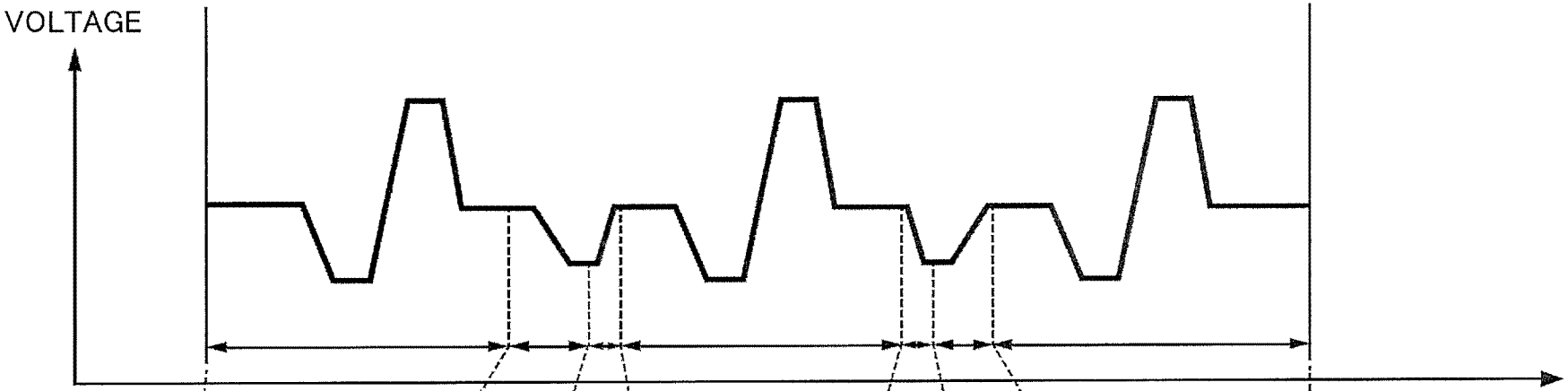
FIG. 10 is a diagram illustrating a comparative example.

FIG. 10 is a diagram illustrating a comparative example. For example, there is a method in which a masking process is applied to the reference waveform W1, to perform switching between discharging and fine-driving. In the figure, spots to which the masking process is applied are designated with dashed lines.

The masking process is performed when the margin for the fine-driving can be secured. In addition, in the case of adopting a configuration in which fine-driving is not performed at all times, it is implemented as a halftone process in the image processing. Alternatively, the masking process is automatically performed at regular intervals by an amplifier board or the like. In such a configuration, if the margin is not secured, side effects may occur such that noise is generated in the drive waveform; failure is generated in an electronic circuit that drives the head; or the like.

In this comparative example, discharging is performed with the first pulse, the fourth pulse, the seventh pulse, and the like. Meanwhile, fine-driving is performed with the third pulse, the sixth pulse, and the like.

Second Embodiment

Note that the fine-driving may be performed at different timing for each nozzle, as follows.

FIG. 11 is a diagram illustrating an example of control according to a second embodiment. In the following, as in FIG. 9, an example will be described in which four nozzles of a first nozzle 1041, a second nozzle 1042, a third nozzle 1043, and a fourth nozzle 1044 are used.

Compared to the first embodiment, the second embodiment differs in that drive waveforms to be input are different for each nozzle. In the following, the description will be given focusing on different points.

Figures 11A, 11B, 11C, 11D, 11E:
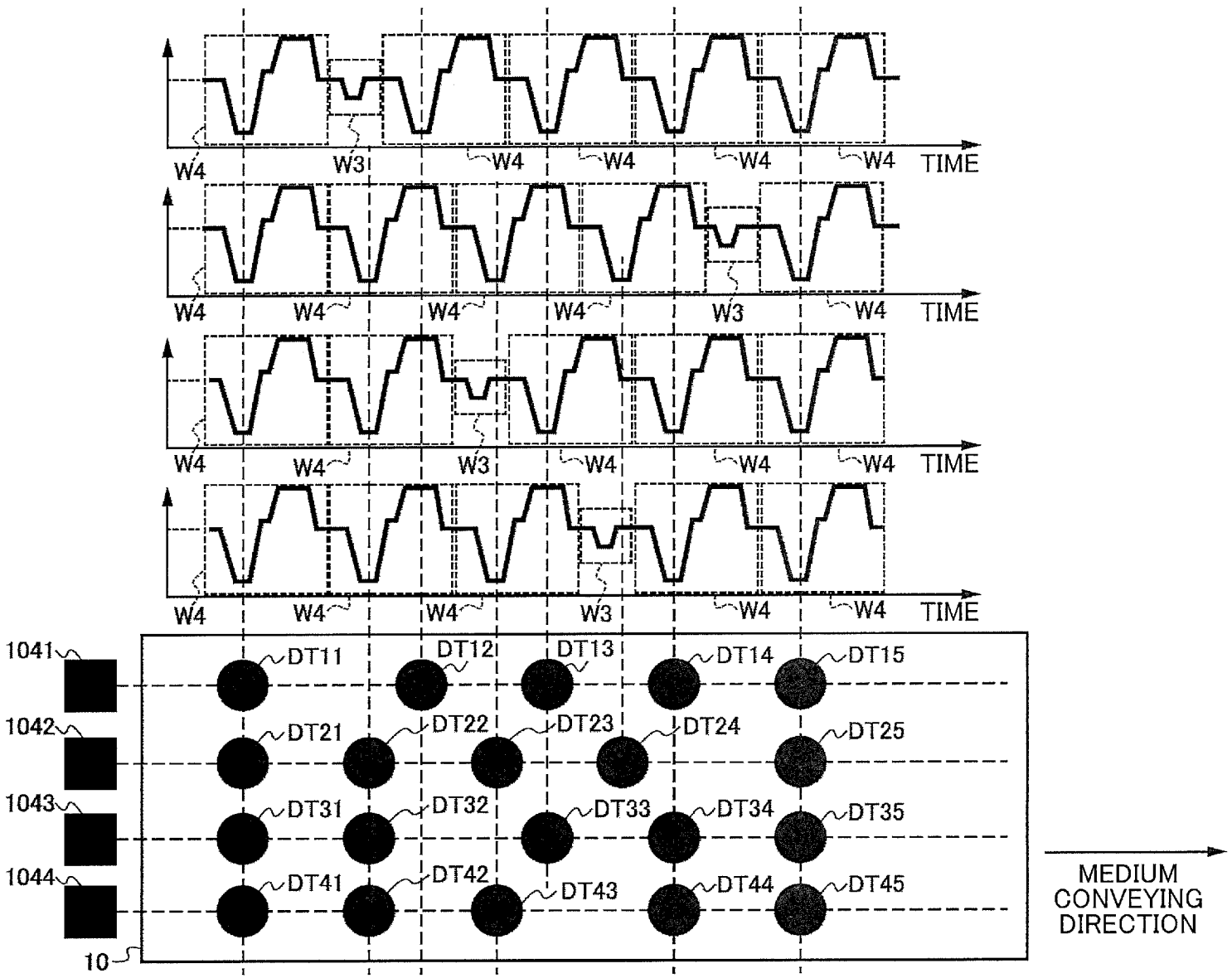
FIGS. 11A to 11E are diagrams illustrating an example of control according to a second embodiment.

FIG. 11A illustrates an example of a drive waveform that is input into the first nozzle 1041.

FIG. 11B illustrates an example of a drive waveform that is input into the second nozzle 1042.

FIG. 11C illustrates an example of a drive waveform that is input into the third nozzle 1043.

FIG. 11D illustrates an example of a drive waveform that is input into the fourth nozzle 1044.

FIG. 11E is an example of dots formed on the continuous paper 10, by the examples of the drive waveforms illustrated in FIGS. 11A to 11D are input.

In this example, control is performed for five times of discharging and one time of fine-driving for each nozzle. In addition, the timing to perform fine-driving (i.e., the timing when the fine-driving waveform W3 is input) is different for each nozzle.

First, it is assumed that an eleventh dot DT11, a twenty-first dot DT21, a thirty-first dot DT31, and a forty-first dot DT41, which constitute the first column of dots, are formed at approximately the same timing.

In the second column, the fine-driving is performed with the first nozzle 1041 at a timing after the first column (i.e., discharge of the eleventh dot DT11) and before the second column (i.e., discharge of a twelfth dot DT12). Therefore, among dots in the second column, the twelfth dot DT12 formed by discharging from the first nozzle 1041 is formed later than the other dots in the second column, which are a twenty-second dot DT22, a thirty-second dot DT32, and a forty-second dot DT42.

In the third column, the fine-driving is performed with the third nozzle 1043 at a timing after the second column (i.e., discharge of the thirty-second dot DT32) and before the third column (i.e., discharge of a thirty-third dot DT33). Therefore, among dots in the third column, a thirteenth dot DT13 formed by discharging from the first nozzle 1041, and a thirty-third dot DT33 formed by discharging from the third nozzle 1043, are formed later than the other dots in the third column, which are a twenty-third dot DT23 and a forty-third dot DT43.

In the fourth column, the fine-driving is performed with the fourth nozzle 1044 at a timing after the third column (i.e., discharge of the forty-third dot DT43) and before the fourth column (i.e., discharge of a forty-fourth dot DT44). Therefore, among dots in the fourth column, a fourteenth dot DT14 formed by discharging from the first nozzle 1041, a thirty-fourth dot DT34 formed by discharging from the third nozzle 1043, and the forty-fourth dot DT44 formed by discharging from the fourth nozzle 1044 are formed later than the other dot in the fourth column, which is a twenty-fourth dot DT24.

In the fifth column, the fine-driving is performed with the second nozzle 1042 at a timing after the fourth column (i.e., discharge of the twenty-fourth dot DT24) and before the fifth column (i.e., discharge of a twenty-fifth dot DT25). Therefore, all of a fifteenth dot DT15, the twenty-fifth dot DT25, a thirty-fifth dot DT35, and a forty-fifth dot DT45, which constitute the fifth column of dots, are formed at approximately the same timing.

In this way, by performing the fine-driving at a different timing for each nozzle, the timing of the delayed dot also becomes different. Therefore, the lag becomes less noticeable.

<Example of Functional Configuration>

Figure 12:
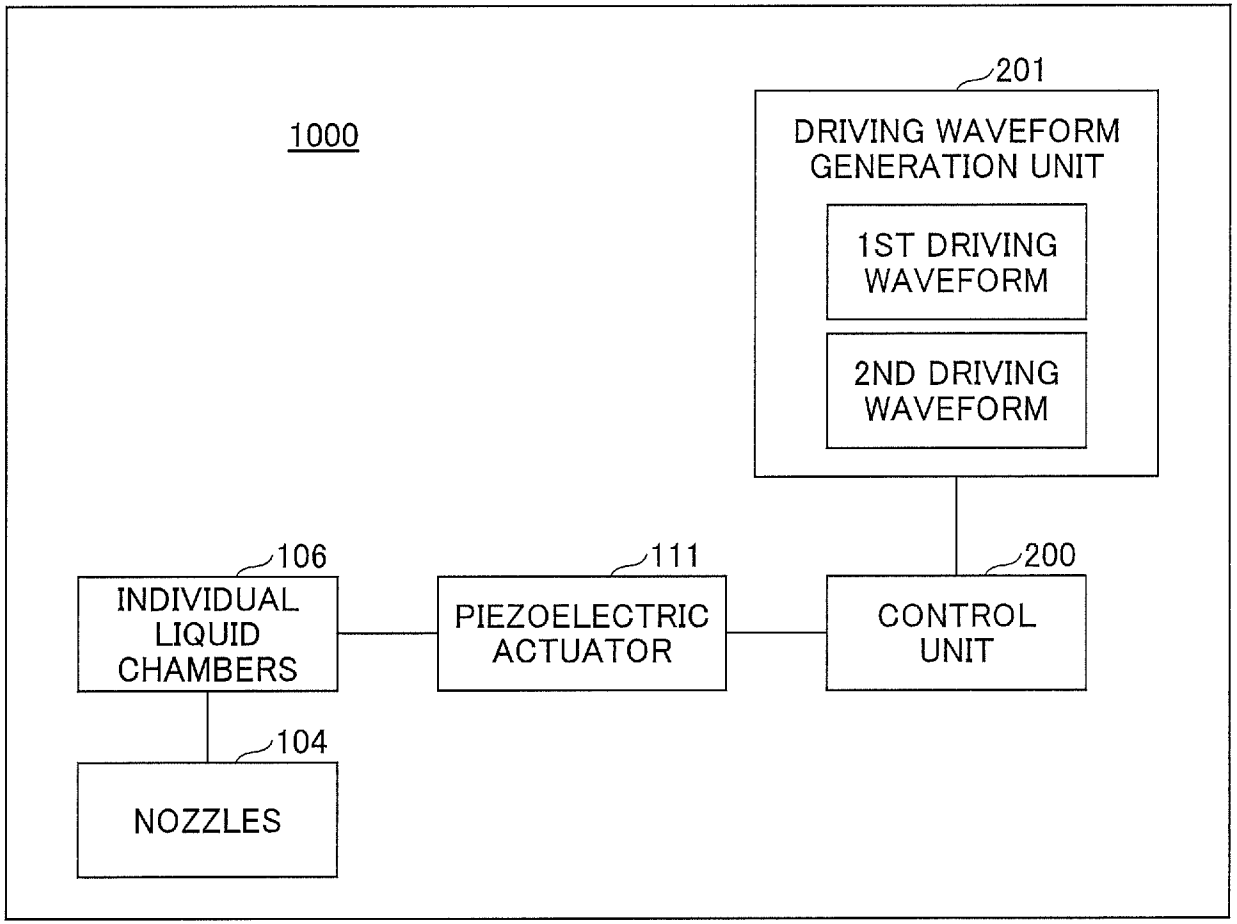
FIG. 12 is a diagram illustrating an example of a functional configuration.

FIG. 12 is a diagram illustrating an example of a functional configuration. For example, the droplet discharging apparatus 1000 has a functional configuration that includes nozzles 104, individual liquid chambers 106, a piezoelectric actuator 111, a controller 200, and a drive waveform generator 201.

For example, the controller 200 is implemented with a configuration such as the main control device 501 illustrated in FIG. 5. Also, the drive waveform generator 201 is implemented with an electronic circuit such as, for example, the drive waveform generation circuit 701 illustrated in FIG. 6.

<Example of Overall Processing>

Figure 13:
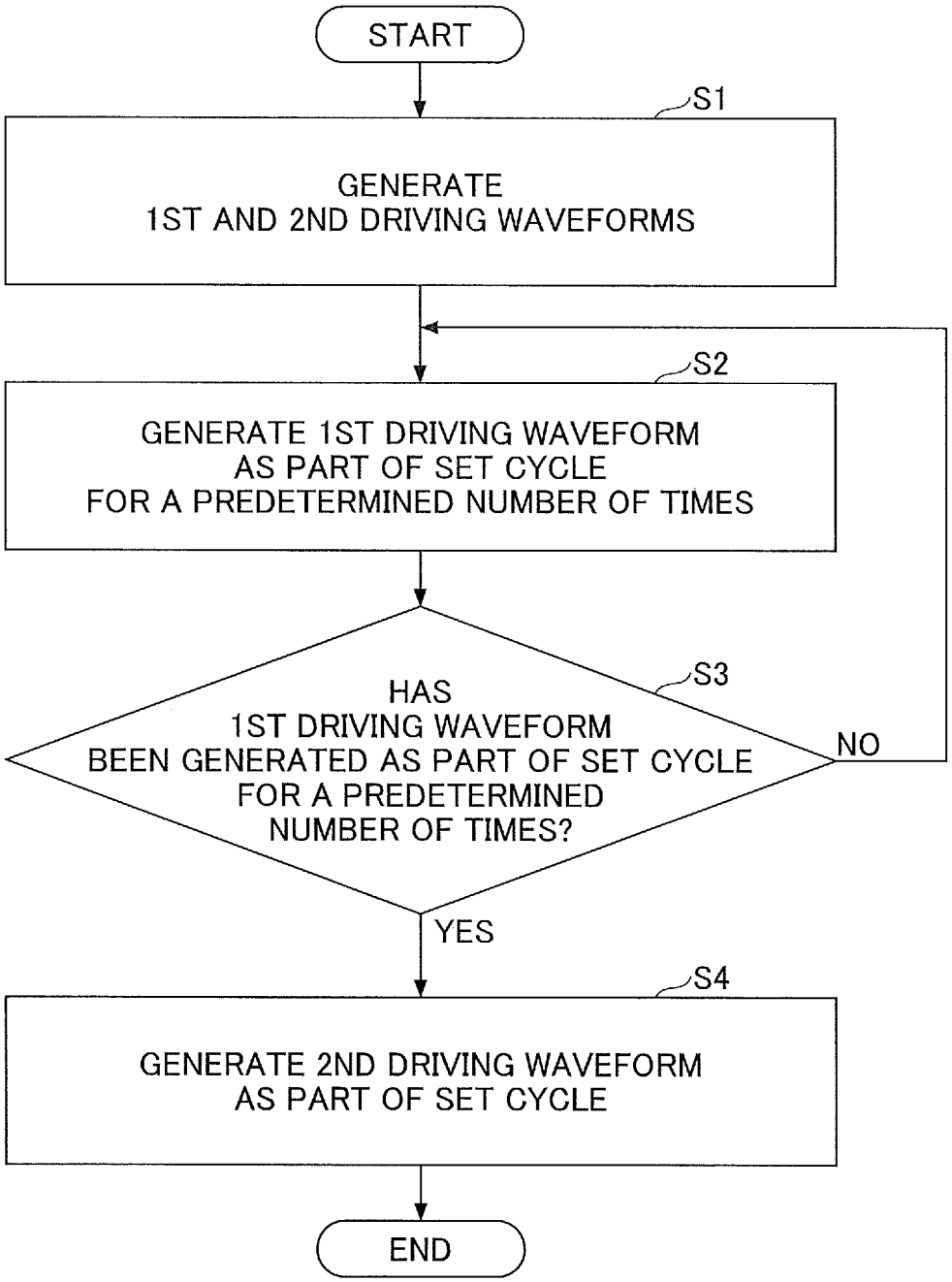
FIG. 13 is a flow chart illustrating an example of overall processing.

FIG. 13 is a flow chart illustrating an example of overall processing.

At Step S1, the drive waveform generator 201 performs a procedure of generating drive waveforms to generates a first drive waveform, a second drive waveform, and the like.

At Step S2, the controller 200 performs a control procedure to generate the first drive waveform as part of a set cycle.

At Step S3, the controller 200 determines whether to generate the first drive waveform as part of the set cycle for a predetermined number of times. In other words, the controller 200 counts how many times Step S2 has been performed; then, the controller 200 determines whether the first drive waveform as part of the set cycle has been generated for a predetermined number of times.

If it is determined that the first drive waveform as part of the set cycle has been generated for the predetermined number of times (YES at Step S3), the process proceeds to Step S4. Meanwhile, if it is determined that the first drive waveform as part of the set cycle has not been generated for the predetermined number of times (NO at Step S3), the controller 200 returns to Step S2.

At Step S4, the controller 200 generates the second drive waveform as part of the set cycle. Then, generation of the first drive waveform (Step S2) is repeated until the predetermined number is reached.

In this way, the entire process generates the first drive waveform as part of the set cycle for the predetermined number of times. Then, when the generation of the first drive waveform reaches the predetermined number (YES at Step S3), the controller 200 generates the second drive waveform as part of the set cycle.

The predetermined number of times is set, for example, depending on the easiness of drying of liquid droplets. Therefore, the timing to perform fine-driving can be adjusted depending on the type of ink or the like.

Note that the overall processing does not necessarily need to be executed as illustrated. Specifically, the generation of the second drive waveform (Step S4 in the figure) is not required to be executed after the generation of the first drive waveform has been performed for the predetermined number of times. In other words, as described in the second embodiment, fine-driving may be executed at any timing in a set of multiple first drive waveforms and a second drive waveform.

[Summary]

According to the configurations as in the first embodiment and the second embodiment, the length of a drive waveform can be shortened even in the case of inputting a drive waveform for performing fine-driving, compared to the case of performing a masking process or the like. Therefore, it is possible to perform operations at a higher frequency.

Modified Examples

In image data synchronized with control for fine-driving, a part for which fine-driving is performed may be distinguished from a part for which fine-driving is not performed. In this way, whether to perform the fine-driving may be determined based on the image data.

Also, the droplet discharging apparatus may further include a potential keeping unit or the like to adjust the length of a discharge waveform or a fine-driving waveform.

Then, when the cycle of the drive waveform is adjusted to be sufficiently short, the next set may be started before performing the fine-driving.

Further, the droplet discharging apparatus may further include a potential keeping unit, for example, in the case of providing different control for each nozzle as in the second embodiment. In this case, for example, if different colors of inks are used for the respective nozzles, the timing to perform fine-driving and the like may be different from nozzle to nozzle, namely, from color to color. In this way, the timing to perform fine-driving can be set differently for each color, namely, depending on the types of liquid droplets. In other words, the easiness of drying and the like may differ depending on the material and the like of the ink. Therefore, it is desirable to have a configuration in which the timing to perform fine-driving can be set differently for each nozzle.

Further, as in the second embodiment, in the case of controlling the respective nozzles differently, and setting the timing to perform fine-driving to be different depending on the color, the timing to perform fine-driving for a nozzle may be adjusted with the timing to perform fine-driving for the other nozzles. In other words, in the case of performing fine-driving on a nozzle with respect to a color affecting the discharge, the timing to perform fine-driving on the other nozzles may be adjusted so as not to perform fine-driving on multiple nozzles at the same time.

Also, the strength of fine-driving may vary from nozzle to nozzle. In other words, for example, as in the second embodiment, in the case of controlling the respective nozzles differently, the fine-driving waveform may vary from nozzle to nozzle.

Depending on the material and the like of the ink, the easiness of drying may differ; therefore, the strength of the fine-driving may differ depending on the types of liquid droplets, and the appropriate strength and weakness of the fine-driving may differ. Therefore, it is desirable to have a configuration in which the strength of fine-driving can be set differently for each nozzle.

Also, the fine-driving may be performed by securing a period of time that is longer than or equal to the time required for the fine-driving. In other words, the fine-driving may be performed by securing a period of time that is longer than L. Note that the additional time to be secured is set in advance. In this way, once a sufficient time is secured, the timing to perform fine-driving can be optimized. Therefore, side effects caused by the fine-driving can be reduced.

Furthermore, it is desirable to control the fine-driving so as not to lengthen the fine-driving waveform after the timing to perform fine-driving is determined. For example, if the accumulation of shortening reaches the cycle of fine-driving, it is desirable to provide an interval between drive waveforms. Such control can reduce side effects caused by the fine-driving.

Note that the fine-driving may be changed to a so-called empty-discharging. In other words, the droplet discharging apparatus may discharge liquid droplets on the recording medium that does not affect image formation and the like, or may discharge liquid droplets onto a location that does not contaminate the recording medium. In some cases, empty-discharging may be more effective than fine-driving. In such cases, it may be configured to perform empty discharge or the like instead of fine-driving.

OTHER EMBODIMENTS

The device does not need to be a single device. In other words, each device may be constituted with multiple devices.

Also, in a droplet discharging apparatus and a liquid droplet discharging system, the liquid droplets are not limited to inks, and may be other types of recording liquids, fixing liquids, and the like. In other words, a droplet discharging apparatus and a liquid droplet discharge system may discharge any type of liquid other than ink. Therefore, a droplet discharging apparatus and a liquid droplet discharge system are not limited to the application of forming images. For example, the object to be formed may be a three-dimensionally formed object or the like.

Furthermore, the recording medium is not limited to a recording medium such as paper. In other words, the recording medium may be of a material onto which liquid droplets can be deposited even temporarily. For example, the recording medium may be any material including paper, yarn, fiber, fabric, leather, metal, plastic, glass, wood, ceramics, combinations of these, or the like.

The driving waveform control method may be implemented by a program or the like. In other words, the driving waveform control method may be executed by installing a program that causes a computer, which serves as a droplet discharging apparatus or a liquid droplets discharge system, to execute the driving waveform control method, by causing an arithmetic/logic device and a control device to interoperate with a storage device and the like.

As above, examples in the embodiments have been described; note that the present inventive concept is not limited to the embodiments described above. In other words, various modifications and improvements can be made within the range according to the present inventive concept.

What is claimed is:

1. A droplet discharging apparatus that discharges liquid droplets from one or more nozzles based on drive waveforms, the droplet discharging apparatus comprising:

a memory; and a processor configured to execute:

generating, as the drive waveforms, a first drive waveform, and a second drive waveform to change a drive voltage without discharging the liquid droplets;

generating the first drive waveform as part of a set of drive waveforms;

determining whether the first drive waveform has been generated as part of the set of drive waveforms for a predetermined number of times;

generating the second drive waveform as part of the set of drive waveforms in a case where the processor has determined that the first drive waveform has been generated as part of the set cycle for the predetermined number of times; and outputting the set of drive waveforms after the second drive waveform has been generated as part of the set of drive waveforms, wherein the predetermined number of times is set based on parameters including a drying rate of the liquid droplets, and a length of one cycle of the second drive waveform is less than or equal to 4 μs.

2. The droplet discharging apparatus as claimed in claim 1, wherein the second drive waveform is added after a last instance among the instances of the first drive waveform that are repeated for the predetermined number.

3. The droplet discharging apparatus as claimed in claim 1, wherein the second drive waveform is added between two instances among the instances of the first drive waveform that are repeated for the predetermined number.

4. The droplet discharging apparatus as claimed in claim 1, wherein the one or more nozzles are a plurality of nozzles, the drive waveform is assigned to each of the plurality of nozzles, and the second drive waveform is added at a different timing in the drive waveform assigned to said each of the plurality of nozzles.

5. The droplet discharging apparatus as claimed in claim 1, wherein the one or more nozzles are a plurality of nozzles, the drive waveforms are assigned to each of the plurality of nozzles, and the second drive waveform is added at a common timing in the drive waveform assigned to said each of the plurality of nozzles.

6. A driving waveform control method executed by a droplet discharging apparatus that discharges liquid droplets from one or more nozzles based on drive waveforms, and includes a memory and a processor, the method comprising:

generating, as the drive waveforms, a first drive waveform, and a second drive waveform to change a drive voltage without discharging the liquid droplets;

generating the first drive waveform as part of a set of drive waveforms;

determining whether the first drive waveform has been generated as part of the set of drive waveforms for a predetermined number of times;

generating the second drive waveform as part of the set of drive waveforms in a case where the processor has determined that the first drive waveform has been generated as part of the set cycle for the predetermined number of times; and outputting the set of drive waveforms after the second drive waveform has been generated as part of the set of drive waveforms, wherein the predetermined number of times is set based on parameters including a drying rate of the liquid droplets, and a length of one cycle of the second drive waveform is less than or equal to 4 μs.

7. A droplet discharging apparatus discharging liquid droplets from a plurality of nozzles based on drive waveforms, the droplet discharging apparatus comprising:

a memory; and a processor that generates a first drive waveform to discharge the liquid droplets and a second drive waveform to change a drive voltage without discharging the liquid droplets, generates the first drive waveform as part of a set of drive waveforms;

determines whether the first drive waveform has been generated as part of the set of drive waveforms for a predetermined number of times;

generates the second drive waveform as part of the set of drive waveforms in a case where the processor has determined that the first drive waveform has been generated as part of the set cycle for the predetermined number of times; and outputs the set of drive waveforms after the second drive waveform has been generated as part of the set of drive waveforms, wherein the predetermined number of times is set based on parameters including a drying rate of the liquid droplets, and a length of one cycle of the second drive waveform is less than or equal to 4 μs.

8. The droplet discharging apparatus as claimed in claim 7, wherein the second drive waveform is added after a last instance among the instances of the first drive waveform that are repeated for the predetermined number.

9. The droplet discharging apparatus as claimed in claim 7, wherein the second drive waveform is added between two instances among the instances of the first drive waveform that are repeated for the predetermined number.

10. The droplet discharging apparatus as claimed in claim 7, wherein the one or more nozzles are a plurality of nozzles, wherein the drive waveform is assigned to each of the plurality of nozzles, and wherein the second drive waveform is added at a different timing in the drive waveform assigned to said each of the plurality of nozzles.

11. The droplet discharging apparatus as claimed in claim 7, wherein the one or more nozzles are a plurality of nozzles, wherein the drive waveforms are assigned to each of the plurality of nozzles, and wherein the second drive waveform is added at a common timing in the drive waveform assigned to said each of the plurality of nozzles.

* * * * *